US007824145B2

(12) United States Patent
Kisse

(10) Patent No.: US 7,824,145 B2
(45) Date of Patent: Nov. 2, 2010

(54) COMMON PIVOT AND SUPPORT MEMBER FOR ATTACHMENT INTERFACE

(75) Inventor: Brandon J. Kisse, Fargo, MN (US)

(73) Assignee: Clark Equipment Company, West Fargo, ND (US)

( * ) Notice: Subject to any disclaimer, the term of this patent is extended or adjusted under 35 U.S.C. 154(b) by 113 days.

(21) Appl. No.: 11/624,850

(22) Filed: Jan. 19, 2007

(65) Prior Publication Data

US 2008/0175701 A1 Jul. 24, 2008

(51) Int. Cl.
*B66C 23/00* (2006.01)

(52) U.S. Cl. ..... 414/723; 37/468

(58) Field of Classification Search ..... 414/723; 37/468

See application file for complete search history.

(56) References Cited

U.S. PATENT DOCUMENTS

| | | | | |
|---|---|---|---|---|
| 3,732,996 | A | | 5/1973 | Bauer |
| 3,876,091 | A | | 4/1975 | MacDonald |
| 4,116,347 | A | | 9/1978 | Uchida |
| 4,812,103 | A | | 3/1989 | Cochran et al. |
| 4,846,624 | A | * | 7/1989 | Hohn ..... 414/723 |
| 5,466,113 | A | * | 11/1995 | Norberg ..... 414/723 |
| 5,639,205 | A | * | 6/1997 | Kaczmarczyk et al. ..... 414/723 |
| 5,732,488 | A | | 3/1998 | Smith |
| 5,820,332 | A | | 10/1998 | Philips et al. |
| 6,238,130 | B1 | * | 5/2001 | Youngers ..... 414/723 |
| 6,773,223 | B2 | | 8/2004 | Harris et al. |
| 6,860,707 | B2 | | 3/2005 | Roan et al. |
| 7,001,136 | B2 | | 2/2006 | Perrin et al. |

* cited by examiner

*Primary Examiner*—Donald Underwood
(74) *Attorney, Agent, or Firm*—John D. Veldhuis-Kroeze; Westman, Champlin & Kelly, P.A.

(57) ABSTRACT

An attachment interface adapted for use with a loader is discussed. The attachment interface includes a horizontally extending cross member configured to be pivotally attached to the loader at each of first and second ends. The attachment interface further includes a first attachment mounting bracket having a generally flat portion and a brace that is attached to and perpendicularly extends from the generally flat portion. A second attachment mounting bracket is spaced apart from the first attachment mounting bracket. The horizontally extending cross member is attached to the brace and the second attachment mounting bracket and wherein the second attachment bracket is otherwise unattached to the first attachment bracket.

18 Claims, 5 Drawing Sheets

COMMON PIVOT AND SUPPORT MEMBER FOR ATTACHMENT INTERFACE

BACKGROUND

The present discussion is related to power machines. More particularly, the present discussion is related to providing an attachment interface to which utility attachments may be coupled. Power machines such as skid steer loaders, tracked vehicles, mini-excavators, utility vehicles, wheel loaders and the like have high utility in construction, landscaping, agriculture, and many other types of applications. Part of that utility includes the ability to engage a number of different types of attachments to perform various tasks. For example, power machines can be attached to buckets, augers, graders, planers, backhoes, grapple forks, to name but a few of a large number of different types of attachments that are available for use with power machines.

Some power machines have an attachment interface mounted thereon to which a number of different types of utility attachments may be engaged. Such attachment interfaces provide a connection point that allows attachments to be quickly and securely attached to the power machine. Additionally, the attachment interface can be manipulated to quickly disengage the attachment from the power machine. Thus, power machines can quickly be decoupled from one attachment and coupled to another attachment, allowing one power machine to perform substantially different tasks simply by exchanging one attachment for another.

The attachment interface for a power machine may have forces applied to it via the power machine and/or the attachment. The attachment interface preferably is capable of withstanding a long term exposure to forces that are applied to it through normal use. There is an ongoing need for attachment interfaces that are easy and cost effective to make, easy to use, and capable of withstanding or avoiding forces applied to them under normal use.

SUMMARY

In one illustrative embodiment, an attachment interface adapted for use with a loader is discussed. The attachment interface includes a horizontally extending cross member configured to be pivotally attached to the loader at each of first and second ends. The attachment interface further includes first attachment mounting bracket having a generally flat portion and a brace that is attached to and perpendicularly extends from the generally flat portion and a second attachment mounting bracket spaced apart from the first attachment mounting bracket. The horizontally extending cross member is attached to the brace and the second attachment mounting bracket and wherein the second attachment bracket is otherwise unattached to the first attachment bracket.

In another illustrative embodiment, a self propelled loader having a frame is discussed. The loader has a lift arm assembly including first and second lift arms pivotally coupled to either side of the frame with a horizontal cross member attached between the lift arms. The loader further includes an attachment interface coupled to the lift arm assembly, including a horizontally disposed element attached to a portion of each of the first and second lift arms along a mounting axis. First and second attachment mounting brackets are attached to the horizontally disposed element and are configured to engage an attachment. The first attachment mounting bracket and the second attachment mounting bracket are otherwise unattached to each other. First and second actuators are pivotally coupled to the lift arm assembly and the first and second attachment mounting brackets, respectively.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

While the above-identified figures set forth one or more illustrative embodiments, other embodiments are also contemplated, as noted herein. In all cases, concepts presented herein describe the embodiments by way of representation and not by limitation. It should be understood that numerous other modifications and embodiments can be devised by those skilled in the art which fall within the scope and spirit of the principles of the discussion herein.

DETAILED DESCRIPTION

Figure 1:
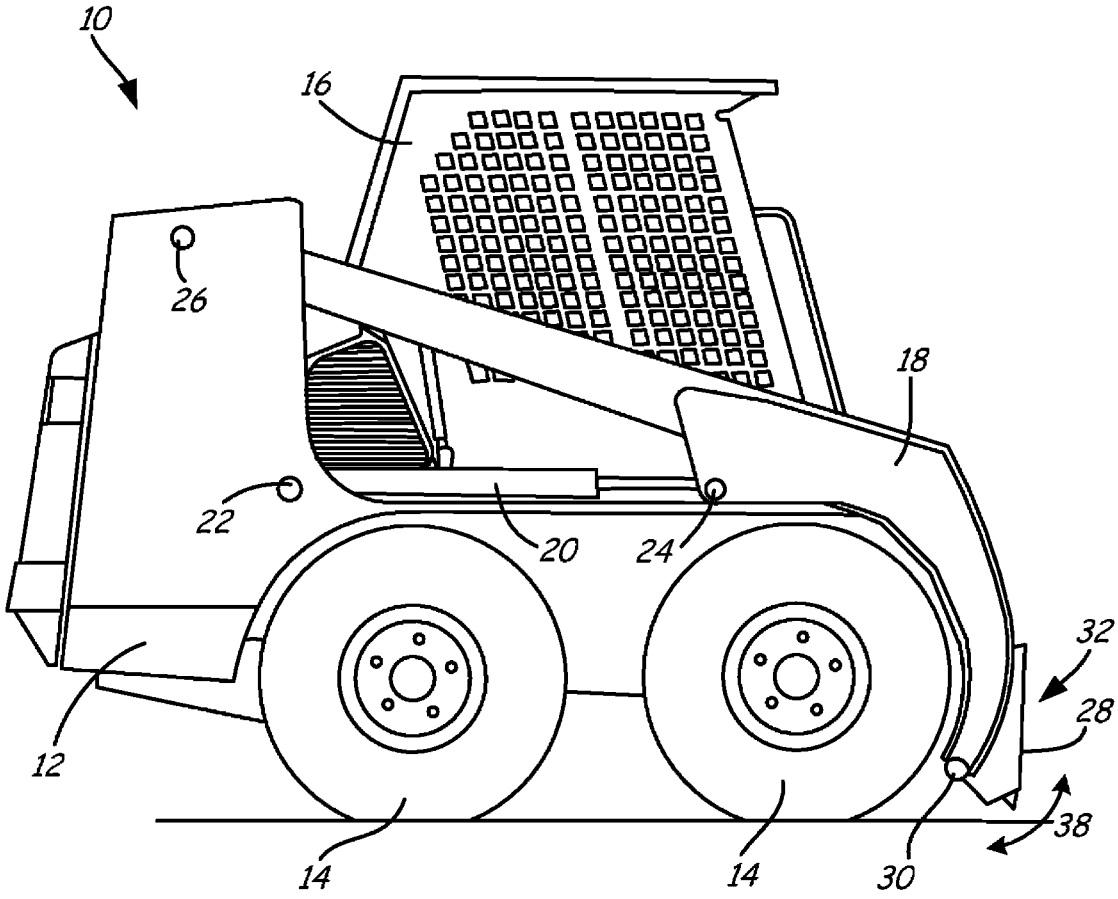
FIG. 1 is a side elevation view of a power machine of the type with a common pivot and support member in an attachment interface discussed herein might be useful.

FIG. 1 illustrates a power machine 10 of the type with which an attachment interface 28 can be usefully employed. Power machine 10 includes a frame 12 that is supported by wheels 14. Power machine 10 has an engine (not shown in FIG. 1) that applies power to a drive system (not shown in FIG. 1), which in turn supplies power to the wheels 14 causing power machine 10 to move under the control of an operator. Frame 12 supports a cab 16, which defines an operating compartment.

An operator can be located inside the cab 16 and control the power machine 10 by manipulating control devices (not shown in FIG. 1) located therein to send operator input signals to the drive system. Although the power machine 10 is shown having a plurality of wheels 14, it should be appreciated that power machine 10 need not have wheels. As one alternative example, power machine 10 can be equipped with one or more tracks that are configured to engage a supporting surface, such as ground, to propel the power machine over the supporting surface.

Power machine 10, as illustrated in FIG. 1, further includes a lift arm 18. Lift arm 18 is coupled to frame 12 at pivot point 26. Actuator 20 is coupled to the frame 12 at first pivot point 22 and the lift arm at second pivot point 24. Actuator 20, of the power machine 10 shown in FIG. 1 is a hydraulic cylinder, although other suitable types of actuators may be used. A single lift arm 18 is shown in FIG. 1, but it is to be understood that a similar lift arm 18 and corresponding actuator 20 may be positioned on the opposite side of the cab and similarly attached to frame 12. Further, it should be understood that such a lift arm may be coupled to the lift arm 18 shown in FIG.

1 via a cross-member (not shown in FIG. 1) extending between and attached to each of the lift arms 18.

The power machine 10 illustrated in FIG. 1 is a skid steer loader. A skid steer loader has rigid axles coupled to each of the wheels 14. The wheels 14 on each side of the skid steer loader are operably coupled to each so that they operate in tandem. Each side of the skid steer loader has its own drive system, which supplies power to the wheels on that particular side. Steering is accomplished by controlling the drive system of one or both sides of the machine to cause the machine to skid on the supporting surface in a direction that is desired by the operator. Alternatively, and without limitation, the discussion herein can be applied to other power machines such as wheeled loaders with a front or rear steerable axle, excavators, utility vehicles, all-wheel steer vehicles, tracked loaders, or any other similar power machine.

Power machine 10 further includes an attachment interface 28, which, in one illustrative embodiment is rotatably coupled to the lift arm 18 about attachment point 30. One or more tilt actuators (not shown in FIG. 1) are coupled to the attachment interface 28 and the one or more lift arms 18 (or the cross-member therebetween). Actuation of the one or more tilt actuators causes the attachment interface 28 to rotate about the attachment point 30 in a direction shown by arrow 38. The attachment interface 28 is, in the illustrative embodiment, attached at or near an end of the lift arm 18 on a distal end 32 of the power machine 10. Alternatively, the attachment interface 28 can be attached to the power machine 10 in any suitable location.

Figure 2:
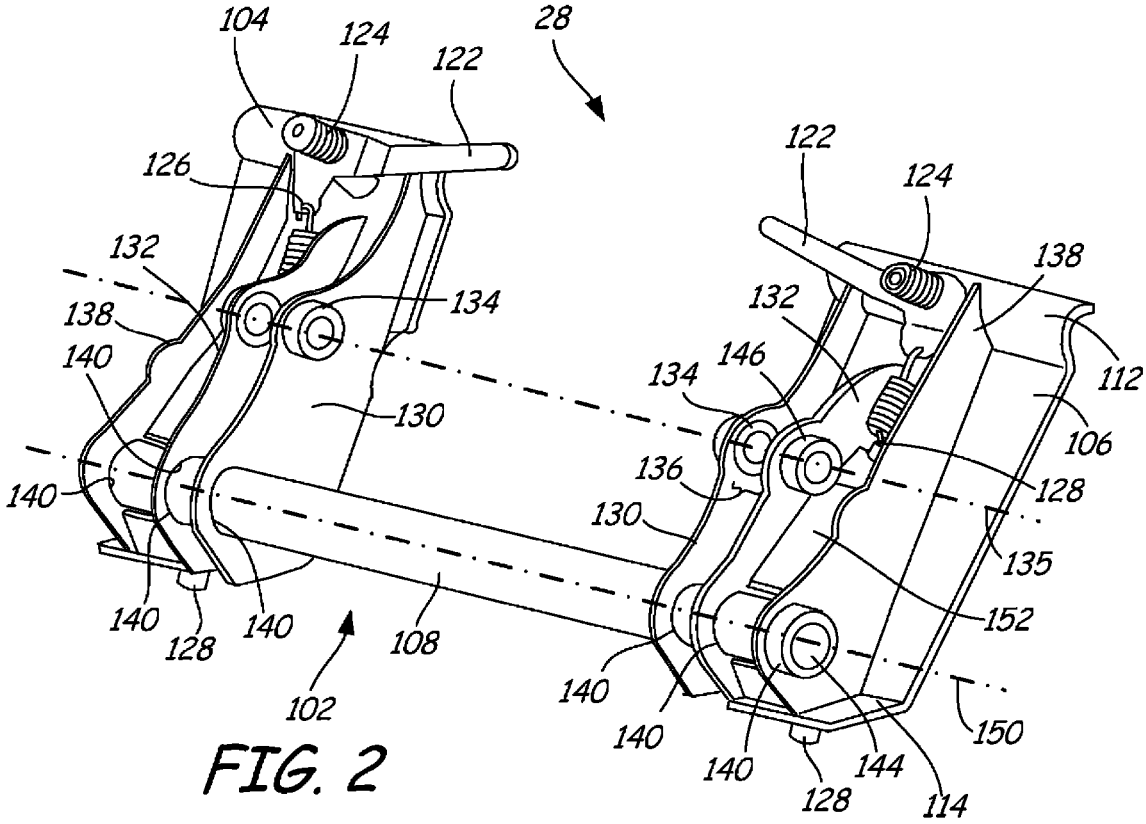
FIG. 2 is a perspective view of an attachment interface for use with the power machine of FIG. 1 according to one illustrative embodiment.
Figure 3:
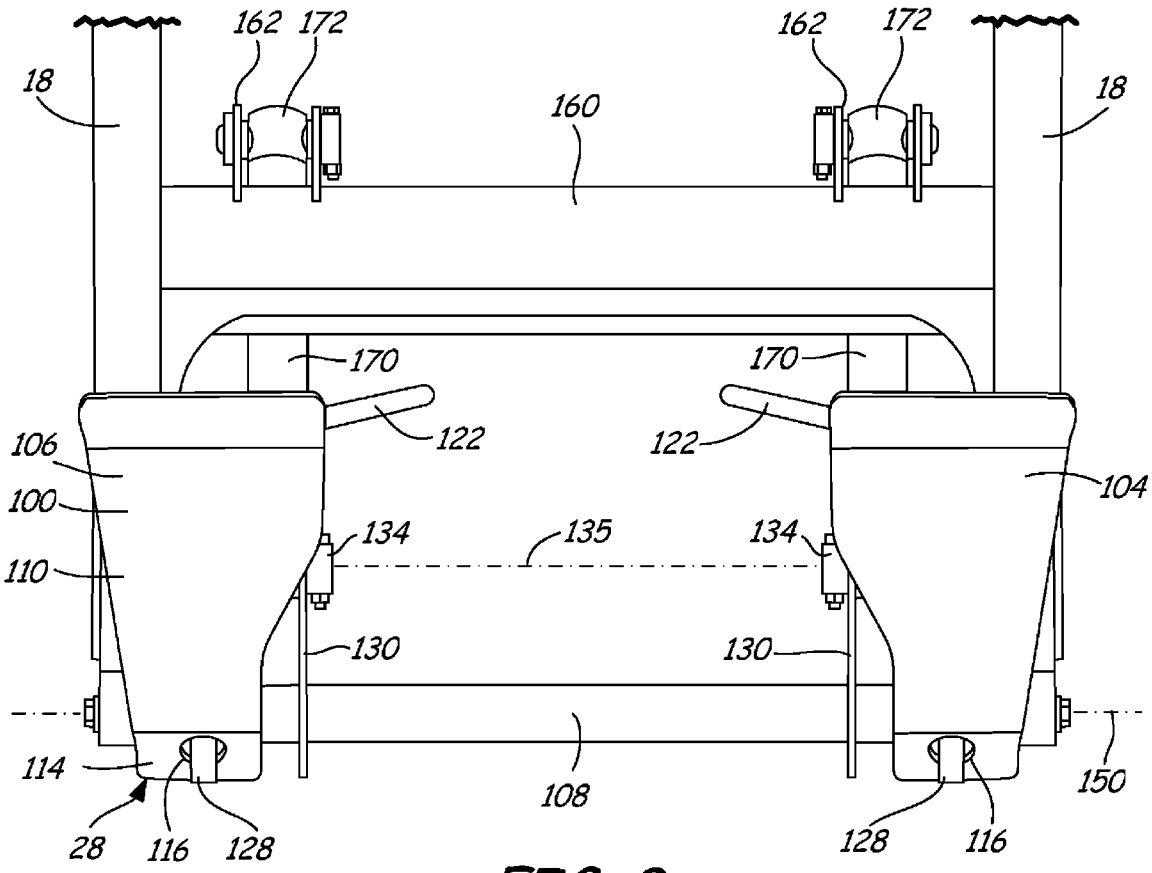
FIG. 3 is a front elevation view of the attachment interface of FIG. 2 connected to a lift arm of the power machine of FIG. 1.
Figure 4:
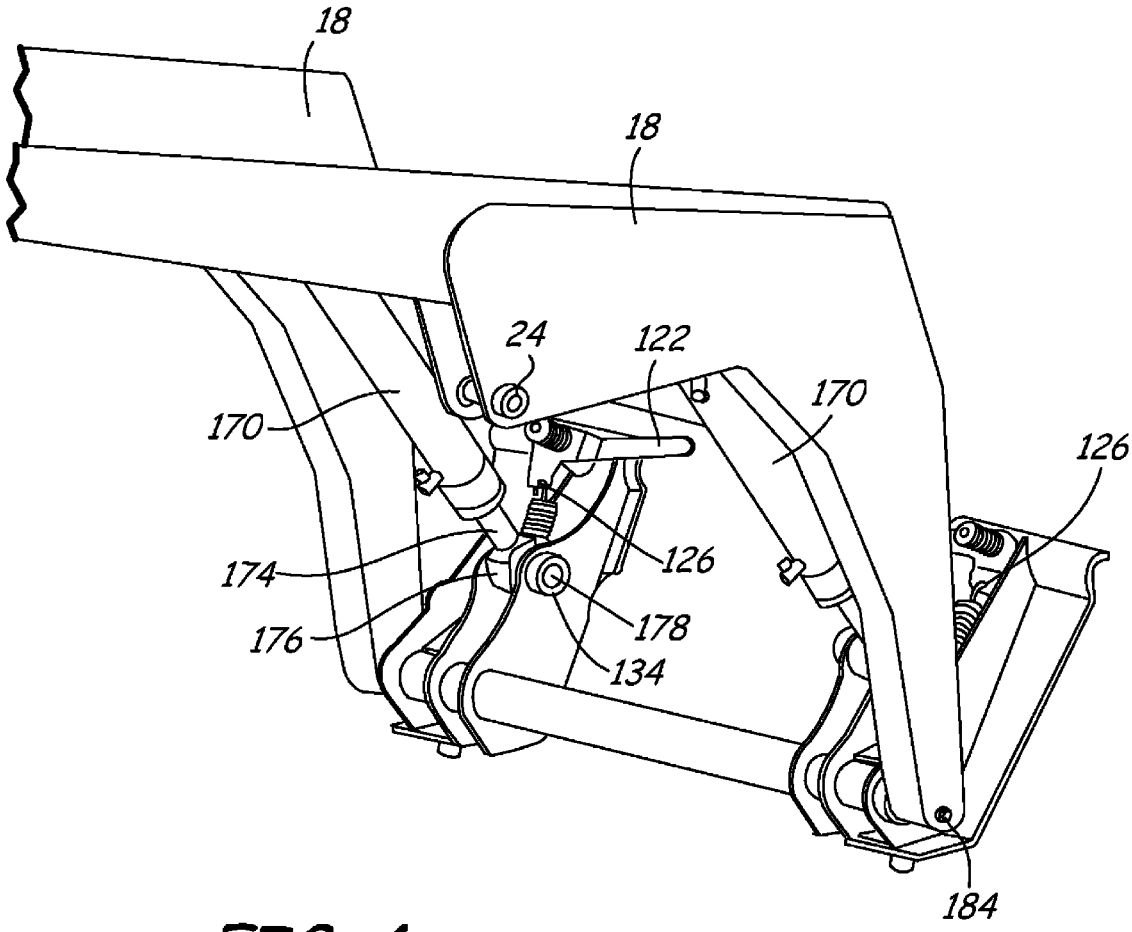
FIG. 4 is a perspective view of the attachment interface of FIG. 3.

FIGS. 2-4 illustrate the attachment interface 28 in more detail. The attachment interface 28 has a first side 100, which is positioned, when the attachment interface 28 is coupled to the power machine 10 as in FIG. 1 so that it faces the distal end 32 of the power machine 10. The attachment interface 28 also has a second side 102 that opposes the first side 100. The attachment interface 28 includes a first mounting bracket 104 and a second mounting bracket 106, which are spaced apart by and attached to a horizontally disposed element or cross tube 108. The attachment interface 28 is attached to the lift arms 18 at the cross tube 108 by a fastener 184 that engages a pin (shown as 182 in FIG. 5) that is inserted in the cross tube 108 at an end 144. Note that in FIGS. 3 and 4 two lift arms 18 are shown. The lift arms 18 are each attached to and spaced apart by cross member 160, as discussed above.

In one illustrative embodiment, each of the first and second mounting brackets 104 and 106 has a generally flat surface 110 along the first side 100. A lip 112 illustratively extends from one end of the flat surface 110 and an angled surface 114 extends away from the flat surface 110 on an opposing end of the flat surface 110. The lip 112, flat surface 110, and the angled surface 114 each are configured to engage a portion of an attachment (not shown).

A wedge 128 is extendable through the angled surface 114 to engage the attachment and secure the attachment to the power machine 10. The wedge 128 is capable of extending and retracting from a wedge guide 116. Wedge 128 is illustratively attached to a handle 122 at a connection point 126. By rotating the handle 122 about pivot 124, the wedge 128 can be extended and retracted to allow the attachment interface 28 to be attached or detached from the attachment. Although the wedge 128 is shown as capable of being manually manipulated by rotation of handle 122, alternatively any actuation mechanism can be used to extend and retract wedge 128, including, for example, an electric motor, a hydraulic cylinder, or any other similar device.

Each of the first and second mounting brackets 104 and 106 is illustratively supported by braces 130, 132, and 138. Braces 130, 132 and 138 extend generally perpendicularly from, and are attached to, the mounting brackets 104 and 106 on a second side 102 of the attachment interface 28. The braces 130, 132, and 138 provide structural support for the first and second mounting brackets 104 and 106. A plate 152 extends between brace 132 and brace 138. The plate 152 illustratively provides reinforcement between the braces 132 and 138. Wedge 128 is positioned between plate 152 and the flat surface 110.

In addition, each of the braces 130, 132, and 138 has an aperture 140, through which the cross tube 108 can be inserted. The cross tube 108 can then be attached to the braces 130, 132, and 138 at the apertures 140 such as by welding the cross tube 108 to the braces 130, 132, and 138. Cross tube 108 is positioned along an axis 150. The attachment interface 28 is illustratively attached to the lift arms 18 at the cross tube 108 so that the attachment interface 28 can pivot about axis 150. Thus, the cross tube 108 provides both an attachment point to the lift arms 18 as well as a connection between the first and second mounting brackets 104 and 106.

The braces 130 and 132 illustratively provide a connection point between actuators 170 and the attachment interface 28. Bushing 134 is attached to the brace 130 and bushing 146 is attached to brace 132 on each of the first and second mounting brackets 104 and 106. The bushings 132 and 146 on each of the first and second mounting brackets 104 and 106 are aligned along axis 135. Axis 135 is illustratively generally parallel to the axis 150.

Actuators 170 are illustratively hydraulic cylinders. A base end 172 of each actuator 170 is illustratively attached to a bracket 162 on cross member 160. A rod 174 of each actuator 170 is pivotally mounted to the braces 130 and 132 of each of the first and second attachment mounting brackets 104 and 106 with a pin 178 that extends though bushings 134 and 146 and an end 176 of the rod 174. Alternatively, other attachments of the actuators 170 can be provided. For example, the base end 172 of the actuators 170 can be attached to the lift arms 18. In addition, the rod 174 can be attached to each of the attachment mounting brackets 104 and 106 at other locations besides braces 130 and 132 without departing from the spirit and scope of the disclosure.

Figure 5:
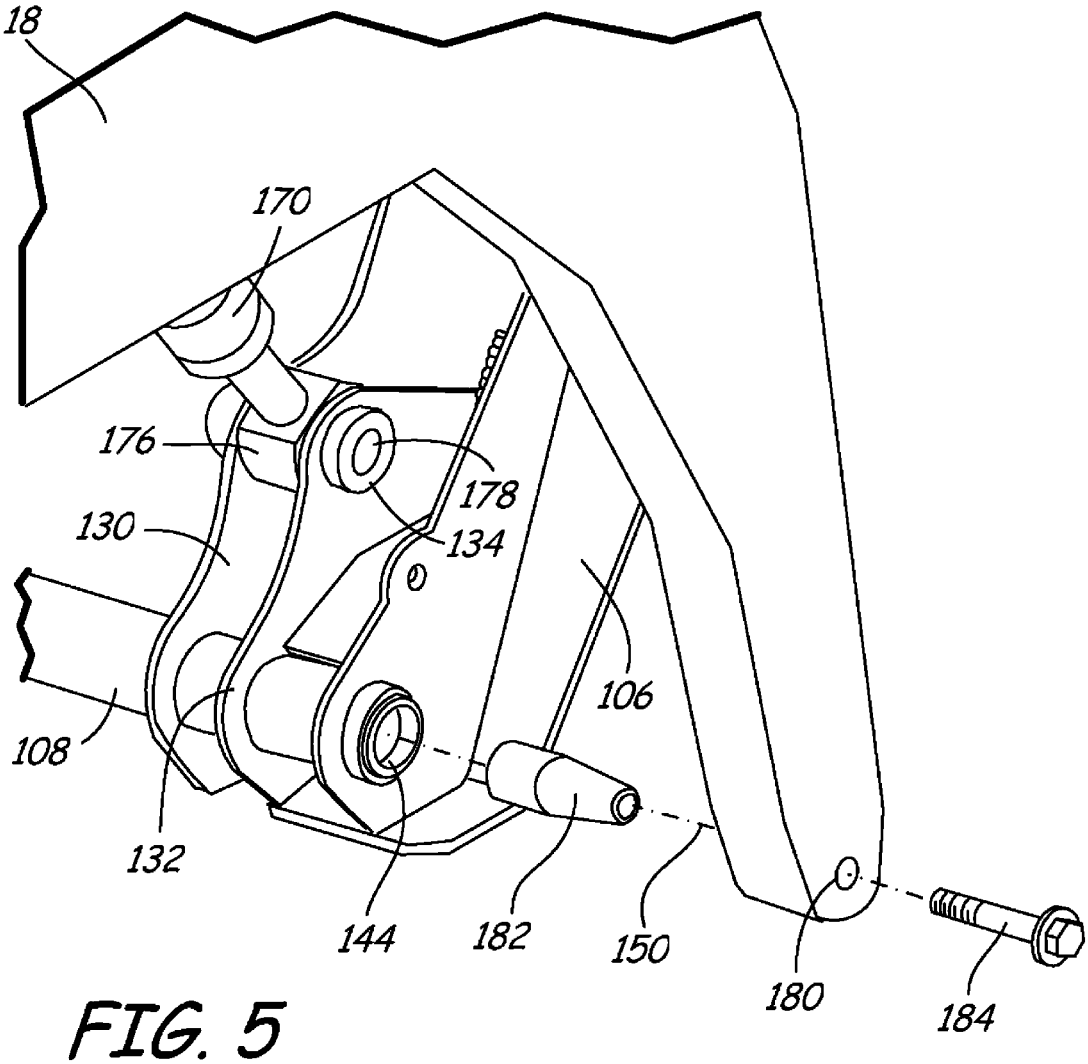
FIG. 5 is an exploded view of a portion of the power machine of FIG. 1 illustrating a connection between the lift arm and the attachment interface.

FIG. 5 illustrates an exploded view of a connection between the lift arm 18 and the attachment interface 28. A pin 182 is inserted into the end 144 of the cross tube 108. Fastener 184 extends through an aperture 180 formed into the lift arm 18. The fastener 184 engages the pin 182 to rotatably secure the attachment interface to the lift arm 18. While only one attachment is shown between the cross tube 108 and the lift arm 18, it is to be understood that each of the lift arms 18 can be attached to the attachment interface 28 with a similar arrangement.

The system described above provides several important advantages. The attachment interface described in the foregoing discussion requires less material and can be manufactured more quickly and using fewer welds than other attachment interfaces. In addition, the use of a cross member that serves as both connection between the attachment mounting plates as well as the connection axis between the lift arms reduces the forces applied to the attachment interface, thereby providing an improved resistance to the effects of fatigue during normal use.

Although the discussion has been focused upon illustrative embodiments, workers skilled in the art will recognize that changes may be made in form and detail without departing from the spirit and the scope of the discussion.

What is claimed is:

1. An attachment interface adapted for use with a loader having a pair of lift arms spaced apart from each other, comprising:

a horizontally extending cross member pivotally attachable to the loader at each of first and second ends of the horizontally extending cross member along an axis that extends through the horizontally extending cross member such that the entire horizontally extending cross member is positionable between the lift arms;

a first attachment mounting bracket having a generally flat portion and a brace that is attached to and perpendicularly extends from the generally flat portion;

a second attachment mounting bracket spaced apart from the first attachment mounting bracket; and wherein the horizontally extending cross member is fixedly attached to the brace and the second attachment mounting bracket and wherein the second attachment bracket is otherwise unattached to the first attachment bracket.

2. The attachment interface of claim 1, wherein the brace further comprises a mount configured to be attached to an actuator.

3. The attachment interface of claim 1, wherein the brace has an aperture extending through it and wherein the horizontally extending cross member extends through the aperture.

4. The attachment interface of claim 1, wherein the second attachment mounting bracket includes a generally flat portion and comprises a plurality of braces that extend perpendicularly from the generally flat portion and wherein each of the braces is attached to the horizontally extending cross member.

5. The attachment interface of claim 4, wherein at least one of the plurality of braces extending from the second attachment mounting bracket further is configured to be attached to an actuator.

6. A self propelled loader having a frame, a lift arm assembly including first and second lift arms pivotally coupled to either side of the frame with a horizontal cross member attached therebetween, and an attachment interface coupled to the lift arm assembly, the attachment interface comprising:

a horizontally disposed element attached to a portion of each of the first and second lift arms at each of the first and second ends of the horizontally disposed element along a mounting axis so that the attachment interface is capable of pivoting with respect to the lift arm assembly about the mounting axis;

first and second pins, each of which extend from one of the first and second ends of the horizontally disposed element and engage the pair of lift arms to pivotally attach the horizontally disposed element to the lift arms;

a first attachment mounting bracket attached to the horizontally disposed element and configured to engage an attachment;

a second attachment mounting bracket attached to the horizontally disposed element and configured to engage an attachment;

a first actuator pivotally coupled to the lift arm assembly and the first attachment mounting bracket;

a second actuator pivotally coupled to the lift arm assembly and the second attachment mounting bracket; and wherein the first and second attachment mounting brackets are permanently attached to the horizontally disposed element at locations between the first and second lift arms and wherein the first attachment mounting bracket and the second attachment mounting bracket are otherwise unattached to each other.

7. The loader of claim 6, wherein the attachment interface is capable of rotating about the mounting axis.

8. The loader of claim 6, wherein the mounting axis is generally perpendicular with respect to the portion of the first and second lift arms to which the attachment interface is attached.

9. The loader of claim 6, wherein the first actuator is pivotally coupled to the horizontal cross member extending between the first and second lift arms.

10. The loader of claim 6, wherein the first attachment mounting bracket includes a plate having a generally flat surface and a perpendicular brace attached to the plate.

11. The loader of claim 10, wherein the brace is attached to the horizontally disposed element.

12. The loader of claim 11, wherein the brace includes an aperture and wherein the horizontally disposed element extends through the aperture.

13. The loader of claim 10, wherein the first actuator is pivotally coupled to the brace.

14. The loader of claim 6, wherein the second attachment mounting bracket includes a plate having a generally flat surface and a pair of perpendicular braces attached to the plate and wherein each of the braces is attached to the horizontally disposed element.

15. The loader of claim 14, wherein only one of the pair of perpendicular braces is attached to the second actuator.

16. The loader of claim 14, wherein both of the pair of perpendicular braces are attached to the second actuator.

17. The loader of claim 14, and further comprising an extendable wedge positioned between the pair of perpendicular braces.

18. The attachment interface of claim 1 and further comprising:

first and second pins, each of which extend from one of the first and second ends of the horizontally extending cross member for engaging the pair of lift arms to pivotally attach the horizontally extending cross member to the loader.

* * * * *